US005267616A

United States Patent [19]

Silva et al.

[11] Patent Number: 5,267,616

[45] Date of Patent: Dec. 7, 1993

[54] PROCESS FOR RUNNING SCRAPERS, PARTICULARLY FOR SUBSEA PETROLEUM WELL LINES

[76] Inventors: José E. M. d. Silva, Rua Mariz e Barros, no. 553/301; Marco A. N. Herdeiro, Rua Senador Vergueiro, no. 214/402; Ricardo W. Capplonch, Rua Paranhose da Silva, no. 320; Luiz V. A. P. Miranda, Praia do Flamengo, no. 82/601, all of Rio de Janeiro, Brazil

[21] Appl. No.: 775,831

[22] Filed: Oct. 15, 1991

[30] Foreign Application Priority Data

Oct. 12, 1990 [BR] Brazil ..... PI 9005125

[51] Int. Cl.[5] ..... E21B 37/00

[52] U.S. Cl. ..... 166/311; 166/170; 166/902

[58] Field of Search ..... 166/311, 170, 177, 902; 15/104.062, 104.063; 138/178

[56] References Cited

U.S. PATENT DOCUMENTS 3,667,544 6/1972 Allimon ..... 166/170
4,007,784 2/1977 Watson et al. ..... 166/170
5,103,524 4/1992 Vowels ..... 15/104.063 X

*Primary Examiner*—Terry Lee Melius

[57] ABSTRACT

A process for running scrapers for subsea petroleum well lines has, according to a first embodiment, launching of a scraper through the line to be disobstructed, towards the wellhead on a step-by-step basis. The operation proceeds by sending the scraper along successively larger sections via reversing flow through the obstructed line to limit passage of the scraper to that obstructed line, until the whole line is swept. Furthermore, according to a second embodiment, the process consists of the launching of one or more scrapers from a chamber installed in the subsea production system, towards the platform, sweeping only the whole obstructed line, all at once. Preferably one or more scrapers are launched from a chamber installed in the subsea equipment towards the surface platform and sweeping the entirety of a first obstructed line. Once cleaning of the obstructed line is completed, new scrapers may be sent from the platform to the subsea equipment chamber where they are stored until a further cleaning operation is required. The chamber installed in the subsea equipment may serve more than one obstructed line.

7 Claims, 1 Drawing Sheet

PROCESS FOR RUNNING SCRAPERS, PARTICULARLY FOR SUBSEA PETROLEUM WELL LINES

FIELD OF THE INVENTION

This invention refers to processes for running scrapers for internal cleaning of petroleum piping or lines or petroleum exploration systems, consisting of subsea launchers or those installed in a stationary production unit at the sea surface, for instance, in a platform.

DESCRIPTION OF THE PRIOR ART

By means of launchers, the scrapers are run into the piping or lines of the petroleum extraction system and displaced by means of gas or fluid pressure. Thus the paraffin and sediments accumulated at the internal walls of the lines are removed.

The allusion herein made to scrapers refers to any device run into the lines with the purpose of removing the incrustations deposited in their internal walls, particularly for paraffin removal. A particularly simple embodiment of known scrapers consists of spheres of diameter adequate to the inside diameter of the lines. In the usual terminology, these scrapers are referred to as pigs.

Processes of the type herein described are already known and utilized for the internal cleaning of petroleum exploration lines, one of the modalities utilized consisting of the so-called circulating pig. According to this process the pig is launched from the surface through one line and returns to the surface through another, making a round trip. The launching of the pig may be achieved through the production or production testing line, and the return through the water or gas injection line or an auxiliary service line, or vice versa.

One disadvantage of this known process is precisely that, when the launcher is located in the stationary production unit or platform, it is necessary that the return lines of the scrapers to the platform and the launching lines have the same diameter, thus increasing the installation costs.

Another known process consists of the utilization of a subsea laucher. It has the disadvantage, however, of requiring that the launcher be periodically reloaded with scrapers, requiring the utilization of vessels for hoisting maneuvers and reinstallation of the launcher, thus increasing the installation costs and risks of accidents.

The purpose of this invention consists of presenting processes which reduce the costs of installation, the costs of operation with periodical launcher reloading, and the risks of accidents.

Such purpose is reached by the invention in view that the scrapers are run into one line and return to their original position through the same line into which they were run, thus dispensing with the return lines which were required in the case of the circulating pig, and with expensive reloading operation which were required in the case of subsea launcher.

SUMMARY OF THE INVENTION

According to this invention the line itself to be cleaned is the transportation means of the scraper, and the launcher/collector may be installed either at the platform or in the subsea equipment.

According to a first embodiment of this invention, a process is provided for running scrapers in which the scraper is launched from the platform through the line to be disobstructed, towards the well head on a step-by-step basis, the operation proceeding by sending the scraper along successively larger sections until the whole line is swept.

Furthermore, according to a second embodiment of this invention, a process is provided in which one or more scrapers are launched from a chamber installed in the subsea production system, towards the platform, sweeping the whole line all at once.

DETAILED DESCRIPTION OF THE INVENTION

Figure 1A:
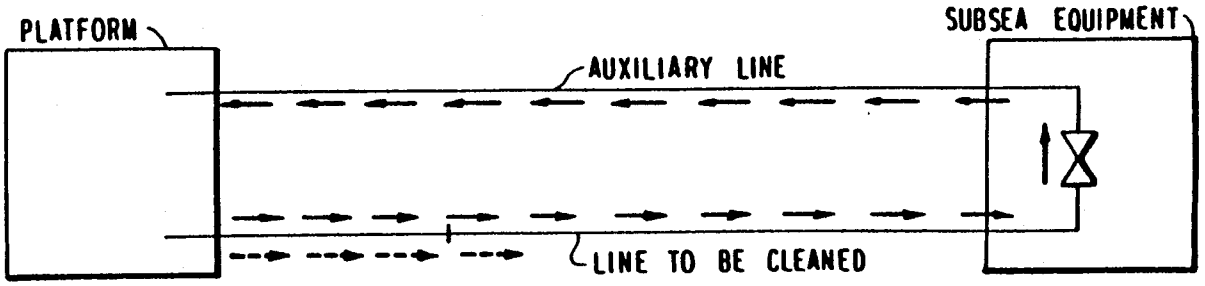
FIG. 1A is schematic view of a subsea petroleum well line connecting a floating platform to subsea equipment illustrating one step of the process of the present invention in a first embodiment.
Figure 1B:
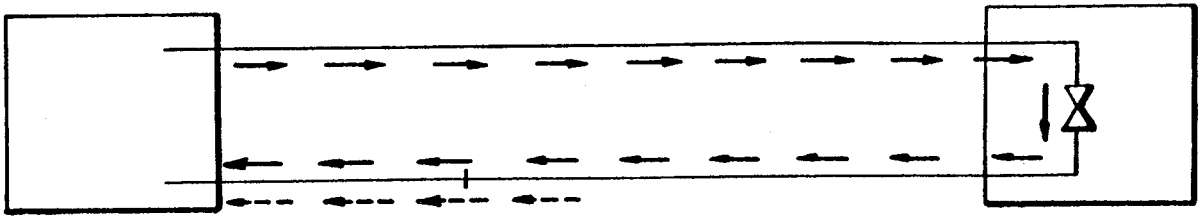
FIG. 1B is a schematic view identical to that of FIG. 1A and illustrating a second step of the process of the first embodiment.

According to a first embodiment of this invention as illustrated in FIGS. 1A, 1B, a process is provided for running scrapers, including the lauching of the scraper, utilizing the launcher installed at the platform, through the line to be disobstructed, that is, same is displaced along a given section, returning to the platform by means of pressure originating from either the platform or the production itself, bringing back the residues. The operation proceeds by sending the scraper along successively larger sections, until the whole line is swept.

Figure 2:
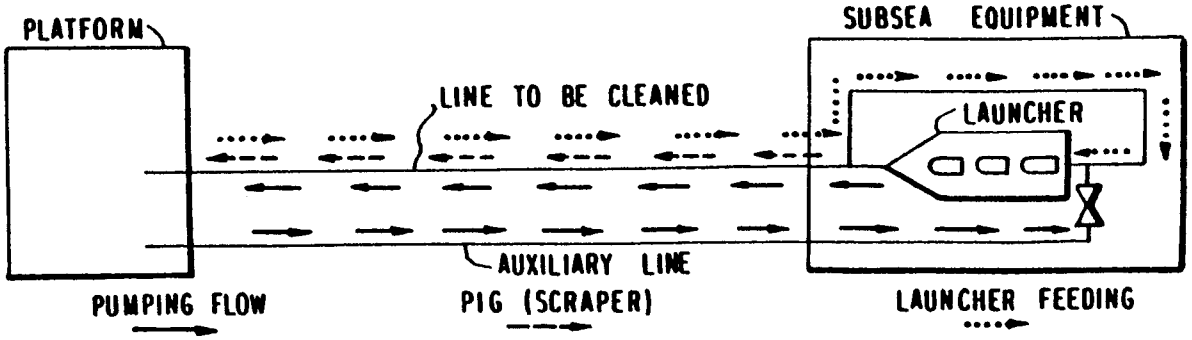
FIG. 2 is a schematic view of a modified form of a subsea petroleum well line forming a second embodiment of this invention.

Furthermore, according to a second embodiment of this invention, as illustrated in FIG. 2, a process is provided for running scrapers, including the launching of one or more scrapers, from a chamber installed in the subsea production system, sweeping the whole line all at once. Once the cleaning of the line is completed by the scrapers, new scrapers are sent through the clean line for storage in the chamber until the next cleaning operation. The pressure required for scraper displacement may originate from either the production itself or the platform, and one same chamber may serve more than one line.

We claim:

1. A process for running scrapers in a subsea petroleum well line connecting a subsea equipment to a surface platform via at least a first obstructed line to be cleaned and a second auxiliary line connectable thereto to form a loop connection between said platform and said subsea equipment, and a launcher/collector including at least one scraper installed at one of said platform and said subsea equipment, said method comprising:

running said at least one scraper along a path limited to said first line through at least a portion of said first line in a first direction from said launcher/collector; and reversely running said at least one scraper through said first line to a return position at said launcher/collector via reverse flow through at least said first line from at least one of said surface platform and said subsea equipment to return said at least one scraper to said return position.

2. The process as claimed in claim 1, wherein said launcher/collector is installed at said surface platform, and said process further comprises launching said at least one scraper from said launcher/collector at said platform through the first line towards the subsea equipment progressively in a step-by-step basis by displacing said scraper along a given section of said first line and returning said at least one scraper to said platform by applying reverse directional pressure originating from returning the residues from either said surface platform or said subsea equipment.

3. The process as claimed in claim 2, further comprising sending said at least one scraper along successively larger sections of said first line until the complete first line is swept.

4. A process for running scrapers through a subsea petroleum well line connecting a subsea equipment to a surface platform via at least a first obstructed line to be cleaned and a second auxiliary connection line connectable thereto to form a loop connection between said platform and said subsea equipment, and a launcher/-collector including at least one scraper within a chamber installed in said subsea equipment located at a sea bottom, said process comprising:

launching said at least one scraper from said chamber towards said platform and sweeping the whole first line in a direction from said launcher/collector to said platform; and reversely running said at least one scraper through said first line to a return position at said launcher/-collector chamber installed in said subsea equipment.

5. The process as claimed in claim 4, further comprising the steps, once cleaning of the first line is completed, of sending new scrapers from said surface platform to said subsea equipment chamber and storing said new scrapers in said chamber until the next line cleaning operation.

6. The process according to claim 4, further comprising the step of effecting pressure required to displace said at least one scraper by a flow through at least said first line from the production at said subsea equipment or a flow originating at said surface platform.

7. The process according to claim 4, wherein said subsea petroleum well line comprises a third, obstructed line to be cleaned, and said process further comprises:

selectively running at least one scraper through at least a portion of said third, obstructed line in a first direction from said launcher/collector; and reversely running said at least one scraper through said portion of said third, obstructed line to return position at said launcher/collector chamber such that said chamber installed at said subsea equipment may serve more than one obstructed line.

* * * * *